US005119838A

United States Patent [19]

Nakazima

[11] Patent Number: 5,119,838

[45] Date of Patent: Jun. 9, 1992

[54] LIQUID PAINTING COMB INSTRUMENT WITH CAP

[75] Inventor: Nobuyuki Nakazima, Takasaki, Japan

[73] Assignee: Mitsubishi Pencil Company, Ltd., Tokyo, Japan

[21] Appl. No.: 657,907

[22] Filed: Feb. 20, 1991

[30] Foreign Application Priority Data

Feb. 20, 1990 [JP] Japan ..... 2-16043[U]

[51] Int. Cl.[5] ..... A45D 24/24

[52] U.S. Cl. ..... 132/108; 132/109; 132/112; 132/116; 401/199; 401/202; 401/283

[58] Field of Search ..... 401/213, 202, 283, 199; 132/108, 109, 116, 112

[56] References Cited

U.S. PATENT DOCUMENTS

| | | | |
|---|---|---|---|
| 3,095,598 | 7/1963 | Gonnella et al. | 401/213 X |
| 3,468,612 | 9/1969 | Aston | 401/202 X |
| 3,554,658 | 1/1971 | Malm et al. | 401/202 X |

FOREIGN PATENT DOCUMENTS

| | | | |
|---|---|---|---|
| 1457027 | 6/1969 | Fed. Rep. of Germany | 401/202 |
| 1461488 | 12/1966 | France | 401/202 |
| 561125 | 4/1957 | Italy | 401/202 |

*Primary Examiner*—Steven A. Bratlie

*Attorney, Agent, or Firm*—Armstrong, Nikaido, Marmelstein, Kobovcik, and Murray

[57] ABSTRACT

A liquid painting instrument according to the present invention includes a main shaft oval-shaped in cross-section, a cap of the same configuration and an elastically deformable O-ring. The O-ring is put on the front end outer periphery of the main shaft such that it may be securely fastened to the inner face of the cap by being elastically deformed following both the configurations of the main shaft and the cap. A front end shaft attached to the main shaft incorporates a plurality of paint cores and comb teeth that are mounted along a major axis of the front end shaft and parallel to each other.

1 Claim, 2 Drawing Sheets

LIQUID PAINTING COMB INSTRUMENT WITH CAP

BACKGROUND OF THE INVENTION

1. Field of the Invention

The present invention relates to an instrument for painting liquid cosmetics such as hair dyes, writing inks, paints, pharmaceuticals, and other liquids.

2. Prior Art

Most of conventional instruments of this kind are circularly-shaped in cross-section in the main shaft thereof and involve such problems as not being handy to carry, and occupying extra space. Although other different types rarely exist whose main shaft is not circular in cross-sectional, they still involve such problems such as the cap does not provide sufficient sealing.

SUMMARY OF THE INVENTION

The present invention is aimed at providing such a liquid painting instrument that is handy to carry without occupying any extra space and that the cap thereof is capable of providing sufficient sealing.

For the purpose of achieving the above aim, the present invention is so constructed that it includes a main shaft oval-shaped in cross-section, a liquid reserving member such as a wadding accommodated in the main shaft and impregnated with a liquid, a rear end sealing member such as a tail plug for sealing the rear end of the main shaft, a front shaft for holding a painting member such as a painting core, the front shaft being fixedly put on the front end of the main shaft, a cap removably engaging with a frontward outer peripheral portion of the main shaft, and a sealing ring such as an O-ring put on a front end outer periphery of the main shaft such that it may be fastened to the inner face of the cap by being elastically deformed to an oval shape following the configuration of the main shaft.

BRIEF DESCRIPTION OF THE DRAWINGS

The present invention may best be understood by reference to the following description taken in connection with the accompanying drawings illustrating a preferred embodiment of a hair coloring instruments, in which.

DETAILED DESCRIPTION OF THE PREFERRED EMBODIMENT

Figure 1:
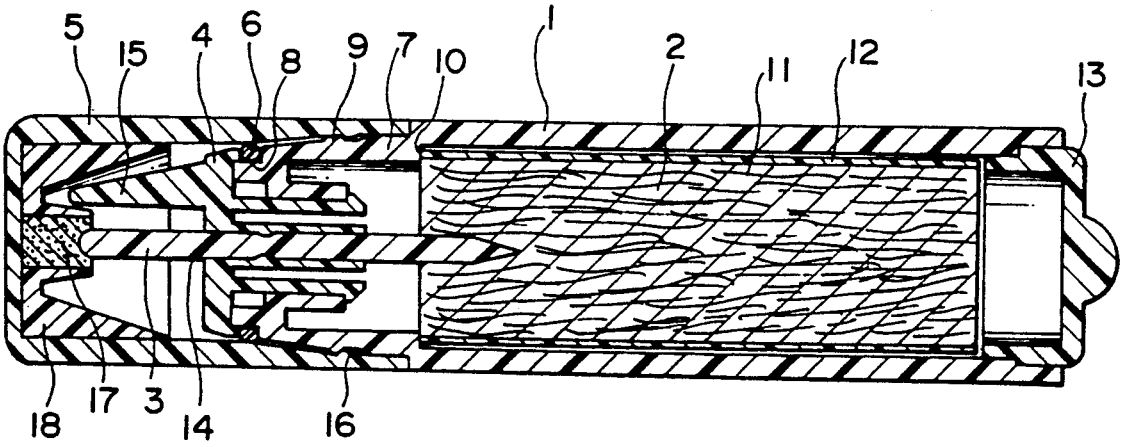
FIG. 1 is a general view in vertical section.
Figure 2:
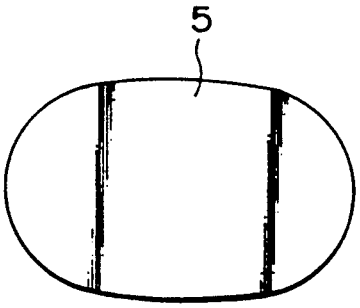
FIG. 2 is a front view in a state wherein the cap in put thereon.
Figure 3:
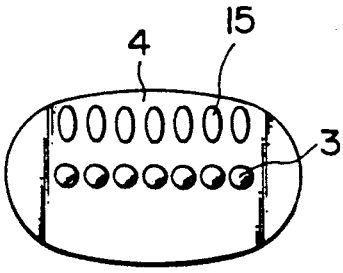
FIG. 3 is a front view in a state wherein the cap is removed.
Figure 4:
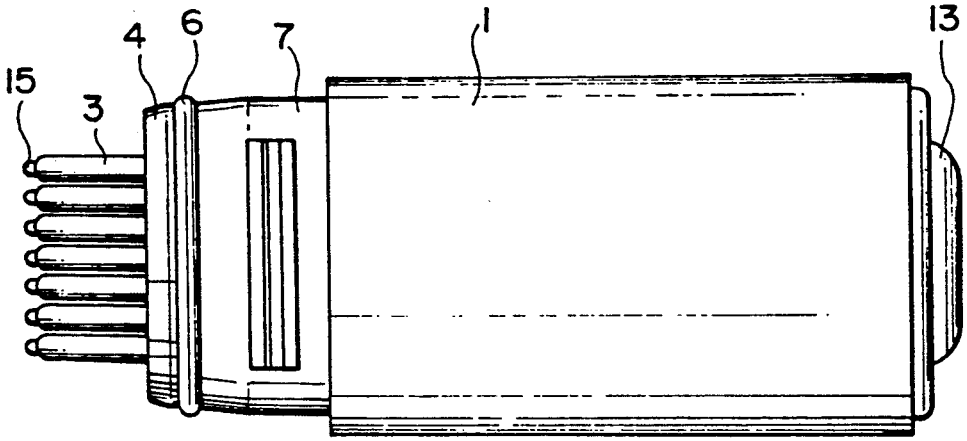
FIG. 4 is a bottom view in the state of FIG. 3.

Referring now to the drawings, a hair coloring instrument will be described as an embodiment of the present invention.

A main shaft 1 with front and rear openings has a front end portion 7 with a tapering diameter and which is the position on which a cap 5 described later is to be put. At a front end periphery of the above tapering portion 7 is formed a stepped portion 8 on which an O ring 6 described later is to be fitted. Along the tapering portion 7 towards its rear end relative to the stepped portion 8, an engaging projection 9 is formed for engaging with the cap 5. At a position inside the main shaft 1 substantially the same as the rear of the tapering portion 7 is formed a stepped portion 10. The main shaft 1 is configured to be oval-shaped in. A wadding 2 is used as a liquid reserving member cross-section. The waddle is made of a bundle of fibres 11 covered except for both its ends by a water impermeable film 12 of a synthetic resin with the bundle of fibres 11 being impregnated with a hair dye. The wadding 2 is inserted from the rear end opening to the inside of the main shaft 1 and is held therein with the front end peripheral edges abutted against the stepped portion 10. A tail plug 13 is put in the rear end opening of the main shaft 1 and it is welded airtight to the main shaft 1. On the stepped portion 8 of the front end peripheral portion of the main shaft 1 is put an O-ring 6 as a sealing ring. The O-ring 6 is, of course, deformed into an oval-shape in following the configuration of the main shaft 1 cross-section where it is placed. On the front end portion of the main shaft 1 is a front shaft 4 which closes the front end opening of the main shaft 1 and securely holds the O-ring 6. The main shaft is perforated substantially at the center portion thereof with a plurality of through holes 14 arranged in a row along the major axis of the oval form. On one side of the through holes 14 are integrally provided a plurality of comb teeth 15 projectioning therefrom. In each of the through holes 14 of the front shaft 1 is inserted a round stick-like painting core 3 made of a fibre as a painting member. The rear end of the painting core 3 is inserted into the wadding 2 in the main shaft 1. The front end of each of the painting cores 3 project forward from the front shaft 4 to a position slightly shorter than the front end of each of the above comb teeth 15. The cap 5 also of the same oval configuration in cross-section as that of the main shaft 1 is put on the tapered portion 7 of the front end of the main shaft 1 and is fixed thereon, with an engaging portion 16 provided on the inside near the opening end thereof engaging with the engaging portion 9 of the main shaft 1. The inner diameter of the cap 5 at a position corresponding to that of the above-mentioned O-ring 6 is designed such that the outer peripheral surface of the O-ring may closely contact with the position where the cap 5 is put on the main shaft 1. Deep in the cap 5 is fixedly inserted an inner shaft 18 which centrally holds a felt 17 contacting the front end of the painting core 3 when the cap 5 is put on the main shaft 1.

Constructed as above, the present invention allows the cross-sectionally oval configuration of the main shaft of the instrument to be thin enough so as to be conveniently carried without occupying any extra space. By fitting the sealing ring which follows the configuration of the main shaft to be elastically deformed to an oval form, a complete seal can be made with the sealing ring closely contacting the inner peripheral face of the cap irrespective of the non-circular configuration in cross-section of the cap.

What is claimed is:

1. A liquid painting instrument, comprising:

a main shaft oval-shaped in cross-section;

a front end shaft tapering and oval-shaped in cross-section attached to a front end of said main shaft;

a wadding located in said main shaft and impregnated with a liquid;

a rear end sealing member attached to a rear end of said main shaft for sealing the rear end of said main shaft;

a plurality of paint cores mounted in said front end shaft, rear ends of said plurality of paint cores extending to and operatively connecting with said wadding, said plurality of paint cores being positioned along a major axis of said front end shaft;

a plurality of comb teeth mounted on said front end shaft positioned substantially parallel to said plurality of paint cores, front ends of said plurality of comb teeth extending out further than front ends of said plurality of paint cores;

a cap removably engageable with a front end outer peripheral portion of said main shaft; and a sealing ring elastically deformed and mounted around the front end outer peripheral portion of said main shaft so as to seal between the front end outer peripheral portion of said main shaft and said cap.

* * * * *